United States Patent [19]

Snow, Jr. et al.

[11] 3,946,506

[45] Mar. 30, 1976

[54] TRIMMER TYPE ROAD CONSTRUCTION APPARATUS WITH PIVOTALLY CONNECTED CONVEYOR

[75] Inventors: Ralph K. Snow, Jr., Oklahoma City; Warren W. Grist, Yukon; Joe Bill Kruger, Oklahoma City, all of Okla.

[73] Assignee: CMI Corporation, Oklahoma City, Okla.

[22] Filed: Sept. 27, 1973

[21] Appl. No.: 401,374

Related U.S. Application Data

[62] Division of Ser. No. 225,936, Feb. 14, 1972, Pat. No. 3,802,525.

[52] U.S. Cl. ..... 37/108 R; 37/DIG. 20; 172/4.5; 172/33; 180/9.46; 198/100; 248/287

[51] Int. Cl.[2] ..... E02F 3/76

[58] Field of Search 37/108 R, 108 A, 110, DIG. 20, 37/98; 172/4.5, 33; 198/97, 98, 99, 100; 180/9.46; 248/287

[56] References Cited

UNITED STATES PATENTS

| | | | |
|---|---|---|---|
| 2,648,422 | 8/1953 | Kling | 198/100 X |
| 2,814,377 | 11/1957 | Jirak | 198/100 |
| 3,423,859 | 1/1969 | Swisher, Jr., et al. | 37/108 R |
| 3,435,546 | 4/1969 | Iverson | 37/108 R |
| 3,445,944 | 5/1969 | Speno | 37/105 |
| 3,540,360 | 11/1970 | Snow, Jr. et al. | 37/108 A X |
| 3,601,910 | 8/1971 | Goltz | 37/98 |
| 3,651,588 | 3/1972 | Hanson | 37/108 R |
| 3,680,233 | 8/1972 | Mac Donald | 37/108 R |

*Primary Examiner*—Clifford D. Crowder
*Attorney, Agent, or Firm*—Dunlap, Codding & McCarthy

[57] ABSTRACT

An improved trimmer type road construction apparatus, particularly useful in applications requiring a high degree of maneuverability and control flexibility, which is steeringly controlled by turning a centrally disposed front track assembly in such a manner that the main frame can be raised and lowered relative to the front drive assembly without a loss of steering control; and which has an automatic steering, grade and slope control constructed to be automatically adapted to particular job specifications and locations. The trimmer also has a reclaimer assembly for removal of the excavated earth, the reclaimer assembly being automatically positionable to deposit the excavated earth in predetermined, controlled positions about the trimmer.

6 Claims, 15 Drawing Figures

TRIMMER TYPE ROAD CONSTRUCTION APPARATUS WITH PIVOTALLY CONNECTED CONVEYOR

CROSS-REFERENCE TO RELATED APPLICATIONS

This application is a divisional of the Applicants' copending application entitled "Trimmer Type Road Construction Apparatus or the Like", Ser. No. 225,936, filed Feb. 14, 1972, now U.S. Pat. No. 3,802,525.

BACKGROUND OF THE INVENTION

1. Field of the Invention

This invention relates generally to improvements in earth working apparatus and, more particularly, but not by way of limitation, to a trimmer having a positive steering, reclaimer, grade and slope control for maneuvering flexibility.

2. Description of the Prior Art

In the past there have been various machines constructed to excavate a portion of earth and, in some instances, these machines have included conveyor like systems to remove the excavated earth and controls to maintain a predetermined elevation of the machine during the operation thereof. Most of the earth working machines, having an earth removal system, have utilized a conveyor like apparatus which was supported and positioned to remove the earth generally from one side of the machine.

In these latter-mentioned machines, the conveyor was rigidly supported on the apparatus or confined to a relatively narrow area of adjustment. Thus, in those applications where the excavated earth was to be removed to some location, other than the location predetermined by the conveyor supported, it was generally necessary to utilize a separate, additional conveyor and supporting apparatus therefor.

The steering of relatively large earth working apparatus has generally presented a problem, particularly in those applications wherein it was necessary to steeringly control the apparatus within a relatively small area and to a relatively high degree of turning accuracy. The steering of such apparatus has been accomplished via a simple shaft, sometimes combined with intricate gearing apparatus, to transfer the motion effected by the operator to steeringly control one or more of the wheels. This problem was complicated in those instances where it was also necessary to raise and lower the main support frame relative to the wheel or track which was steeringly controlled.

In many earth working applications, it also becomes necessary to control the grade and the slope of the excavatingly engaged earth. In some instances, sensors have been utilized in the past to sense the position of the apparatus relative to a control reference, such sensors being commonly supported on one side of the apparatus.

SUMMARY OF THE INVENTION

One object of the invention is to provide a trimmer having increased maneuverability and control flexibility.

Another object of the invention is to provide an improved, more efficient steering control for a trimmer or the like.

One other object of the invention is to provide an improved, more efficient reclaimer which can be automatically positioned to deposit excavated earth in predetermined, controlled positions.

Yet another object of the invention is to provide a more economical and efficient sensor support for earth working apparatus.

Another object of the invention is to provide a trimmer which can be controlled relative to a control reference from either side of the trimmer.

An additional object of the invention is to provide a trimmer having a more efficient, economical, controllable excavating width extension which is automatically positionable.

A still further object of the invention is to provide a trimmer which is more economical in construction and operation.

Other objects and advantages of the invention will be evident from the following detailed description when read in conjunction with the accompanying drawings which illustrate the various embodiments of the invention.

BRIEF DESCRIPTION OF THE DRAWINGS

FIG. 8 is a side elevational view of the reclaimer and the conveyor position control of the trimmer of FIG. 1.

FIG. 9 is a fragmentary, diagrammatical view of the auger and the moldboard.

FIG. 10 is a perspective view of the conveyor support and the conveyor position control of the trimmer of FIG. 1.

DESCRIPTION OF THE PREFERRED EMBODIMENT

Figure 1:
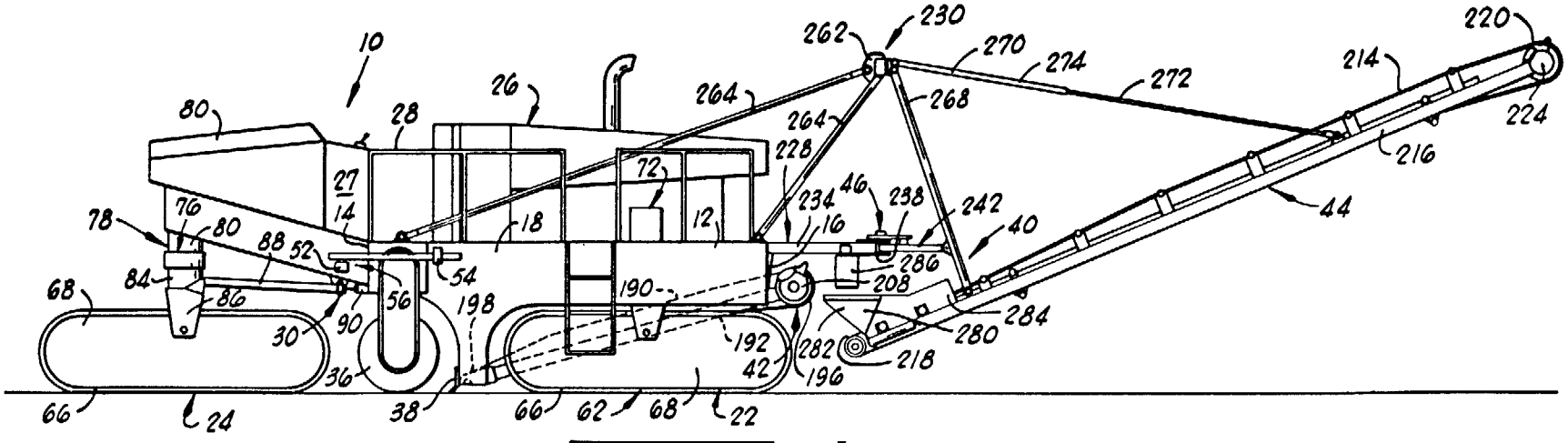
FIG. 1 is a side elevational view of the trimmer constructed in accordance with the present invention.

Referring to the drawings in general, and to FIGS. 1 and 2 in particular, shown therein and designated by the general reference numeral 10 is a trimmer-type road construction apparatus, referred to below simply as the trimmer 10, which includes a main frame 12, having a forward end 14, a rearward end 16, a left side 18, and a right side 20. The trimmer 10 is particularly useful in applications wherein the available working space is relatively limited, and yet wherein a high degree of automatic control and flexibility are required such as, for example, "single lane" type of highway and street construction and parking lot construction or the like. The trimmer 10 has a design, a control flexibility, a positive steering control and an earth removal or reclaimer assembly, each being constructed to excavate, remove the excavated earth, and excavatingly prepare a surface to a predetermined grade and slope, in a manner to be described in greater detail below.

The main frame 12 is supported via a rear drive assembly 22 and a front track assembly 24, the drive assembly 22 being drivingly connected to a power drive unit 26 for drivingly moving the main frame 12 during the operation of the trimmer 10. The power drive unit 26 may be of a conventional design such as, for example, a diesel powered engine, and the construction and operation of such a power unit, and the various interconnecting components and operation thereof to drivingly connect the power drive unit 26 to the endless track members are well known in the art and a detailed description thereof is not required herein. The major portion of the various manually-operated, control actuating elements, which are utilized by an operator to control and operate the trimmer 10 are, in a preferred form, supported in a control console 27. The control console is supported on the main frame 12, generally near the forward end 14 thereof, and a guard-rail type of structure 28 is connected to the main frame 12, the guard-rail 28 extending generally about the main frame 12, as shown in FIGS. 1 and 2.

A steering assembly 30 is connected to the main frame 12 and to a portion of the front track assembly 24 for steering the trimmer 10. More particularly, the steering assembly 30 is constructed to automatically steer the front track assembly 24 in a steering direction 32 and a steering direction 34, as shown in FIG. 2, to steeringly maintain the alignment of the trimmer 10 relative to a control reference, commonly a "stringline", in one aspect of the operation of the trimmer 10, as will be described in greater detail below.

An auger 36 is rotatingly supported on the main frame 12, generally near the forward end 14 thereof, and a moldboard 38 is also connected to the main frame 12, generally near the auger 36. The auger 36 and the moldboard 38 are each constructed to excavatingly engage an adjacent portion of the earth, during the operation of the trimmer 10.

A reclaimer assembly 40, which generally includes a base conveyor 42 and an elevated conveyor 44, is supported on the main frame 12 for receiving the earth excavated via the auger 36 and the moldboard 38 and deposits same in a predetermined, controlled, remote location. The base conveyor 42 is supported generally between the left side 18 and the right side 20, and extends angularly from the forward end 14 toward the rearward end 16 of the main frame 12. A portion of the base conveyor 42 is disposed near the moldboard 38, the moldboard 38 and the auger 36 each being constructed to move the excavated earth onto the base conveyor 42, in manner to be described in greater detail below.

The base conveyor 42 moves the excavated earth toward the rearward end 16, the excavated earth being subsequently deposited onto the elevated conveyor 44. The elevated conveyor 44 is connected generally at the rearward end portion 16 of the main frame 12, and is constructed to move the excavated earth deposited thereon to the controlled, predetermined locations. More particularly, a conveyor position control 46 is connected to the elevated conveyor support structure such that the elevated conveyor 44 can be automatically moved in a swing direction 48 and in a swing direction 50 to deposit the excavated earth therefrom generally outwardly from the left side 18 or the right side 20 of the main frame 12, or at any predetermined, intermediate position therebetween, in a manner which will be described in greater detail below.

In a preferred form and during one aspect of the operation of the trimmer 10, the steering assembly 30 is automatically actuated in response to an output signal of a track steering sensor 52, and the elevation of the main frame 12 relative to the front track assembly 24 is automatically actuated and controlled via a front elevation sensor 54. The track steering sensor 52 and the elevation sensor 54 are each supportedly connected to the left side 18 of the main frame 12, generally near the forward end 14 thereof, via a front sensor support 56.

The sensor support 56 is constructed such that the elevation and the distance between the sensor support 56 and the main frame 12 are each adjustably controlled, the distance between the sensor support 56 and the main frame 12 being, more particularly, adjustably controlled and positionable from a remote position, as will be described in greater detail below.

The elevation of a portion of the rear drive assembly 22 is, in a preferred form, constructed such that the elevation of one portion thereof is locked or set in a predetermined elevation setting and such that the elevation of one other portion thereof is automatically controlled via an automatic slope control to position the trimmer 10 in predetermined grade and slope positions during the operation thereof. The control apparatus is also constructed to cooperate with the trimmer 10 such that the sensors 52 and 54 can be supported from the left side 18 of the main frame 12, as shown in FIGS. 1 and 2, or the right side 20 of the main frame 12 (not shown), as will be made more apparent below.

The utilization of sensors such as the track steering sensor 52 and the elevation sensor 54, described above, which are constructed to provide an output signal responsive to a control reference, are well known in the art, such sensors, for example, being described in U.S. Pat. No. 3,423,859, entitled "Road Construction Methods and Apparatus", assigned to the assignee of the present invention. Therefore, a detailed description of the various components, and the cooperation of those components to provide a responsive output signal is not required herein.

The rear drive assembly 22 includes a left track assembly 62 and a right track assembly 64, the left track assembly 62 being connected to the main frame 12 generally near the left side 18 thereof, and the right track assembly 64 being connected to the main frame 12 generally near the right side 20 thereof.

The left track assembly 62 and the right track assembly 64 each include an endless track member 66 which is drivingly supported via a track support member 68. The left track assembly 62 and the right track assembly 64 are each driven via a hydraulic motor. The front track assembly 24 also includes an endless track member 66 movably supported on a track support member 68. The interconnection between the hydraulic motors and the rear drive assembly 22 to drivingly move the endless track members 66 connected thereto is well known in the art, and a detailed description thereof is not required herein.

The trimmer 10 also includes a left elevation positioning assembly 72, a right elevation positioning assembly 74 and a front elevation positioning assembly 76. The left elevation positioning assembly 72 has a portion connected to the track support member 68 of the left track assembly 62 and another portion connected to the main frame 12 to raise and to lower the main frame 12 in a vertically upwardly and downwardly direction, in an actuated position thereof. The right elevation positioning assembly 74 has a portion connected to the main frame 12 and another portion connected to the track support member 68 of the right track assembly 64 to raise and lower the main frame 12 in a vertically upwardly and downwardly direction, in an actuated position thereof. The front elevation positioning assembly 76 has a portion connected to the track support member 68 of the front track assembly 24 and another portion connected to the main frame 12 to raise and lower the main frame 12 in a vertically upwardly and downwardly direction, in an actuated position thereof. The left elevation positioning assembly 72, the right elevation positioning assembly 74 and the front elevation positioning assembly 76 each include a double-acting hydraulic cylinder having a reciprocating piston (now shown in detail) mounted in a cylinder (not shown in detail), the piston of each hydraulic cylinder being connected to a portion of one of the track support members 68 and the cylinder of each hydraulic cylinder being connected to the main frame 12. Each hydraulic cylinder is constructed and disposed to raise and lower the main frame 12 to position the main frame 12 in predetermined grade and slope positions, in a manner to be made more apparent below.

As shown more clearly in FIG. 1, the front track assembly 24 is, more particularly, connected to the main frame 12 via a front track support assembly 78 which is connected to a support extension 80. The support extension 80 is securedly connected on one end thereof to a central portion of the main frame 12, the support extension 80 extending a distance from the forward end 14 of the main frame 12 in a generally forward direction. The front track assembly 24 is, more particularly, connected to the support extension 80, and the support extension 80 is constructed such that, in the assembled position of the trimmer 10, the front track assembly 24 is generally centrally positioned between the left track assembly 62 and the right track assembly 64 of the rear drive assembly 22, and further such that the front track assembly 24 is spaced a distance in a generally forward direction from the forward end 14 of the main frame 12.

Generally speaking, the trimmer 10 is constructed to be driven in a generally forward direction via the rear drive assembly 22, the auger 36 and the moldboard 38 excavatingly engaging an adjacent portion of the earth during the operation of the trimmer 10. The excavated earth is moved by the auger 36 generally toward a central portion of the moldboard 38 and through an opening therein onto the base conveyor 42.

The base conveyor 42 moves the excavated earth toward the rearward end 16 of the main frame 12 and onto the elevated conveyor 44. The elevated conveyor 44 moves the excavated earth to predetermined, controlled locations. More particularly, conveyor position control 46 automatically swings the elevated conveyor 46 in a swing direction 48 and 50, thereby positioning the elevated conveyor 44 at controlled positions within a swing path generally within a 180 degree radius about the rearward end 16 of the trimmer 10. In this manner, the operator can easily control the disposition of the elevated conveyor 44 to deposit the excavated earth in predetermined positions which will vary depending upon a particular job specification or location, without the necessity of utilizing additional, separately mounted conveyors and conveyor support apparatus.

The trimmer 10 is steeringly moved via the front track assembly 24, the auger 36 and the moldboard 38 being supported generally between the front track assembly 24 and the rear drive assembly 22, in steering directions 32 and 34. The steering movement of the front track assembly 24 is controlled in response to an output signal of the track steering sensor 52, in one aspect of the operation of the trimmer 10.

STEERING ASSEMBLY

Figure 4:
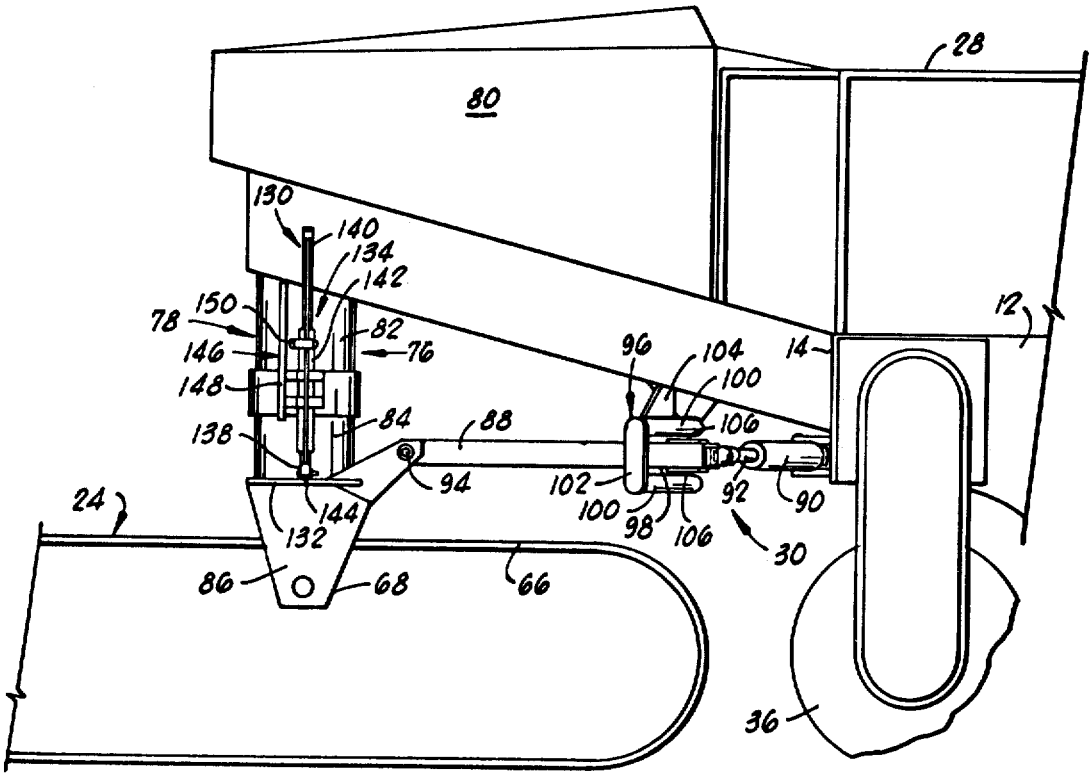
FIG. 4 is an enlarged, side elevational view of a portion of the steering assembly of the trimmer of FIG. 1.

As shown more clearly in FIG. 4, the front elevation positioning assembly 76, more particularly, includes a first housing 82 and a second housing 84, the first housing 82 and the second housing 84 each being generally cylindrically shaped, in a preferred form. One end of the first housing 82 is securedly connected to a lower portion of the support extension 80, and one end of the second housing 84 is securedly connected to a yoke 86, the yoke 86 being connected to the track support member 68 of the front track assembly 24. A portion of the second housing 84, opposite the end thereof connected to the yoke 86, is telescoped through the end of the first housing 82, opposite the end thereof connected to the support extension 80.

As shown more clearly in FIGS. 3, 4, 5 and 6, the steering assembly 30 includes a steering arm 88 which is connected on one end thereof to the front track assembly 24, and a steering cylinder 90 which, in a preferred form, is a hydraulically operated cylinder having a piston rod 92 reciprocatingly disposed therein. One end of the steering cylinder 90 is pivotally connected to the forward end 14 of the main frame 12, generally near the right side 20 thereof, and one end of the piston rod 92 is pivotally connected to the end of the steering arm 88, opposite the end thereof which is connected to the front track assembly 24. The steering cylinder 90 has an actuated turning position for moving the steering arm 88 in a steering direction 32 and 34, thereby turning the front track assembly 24 to steeringly maneuver the trimmer 10 during the operation thereof.

Figure 3:
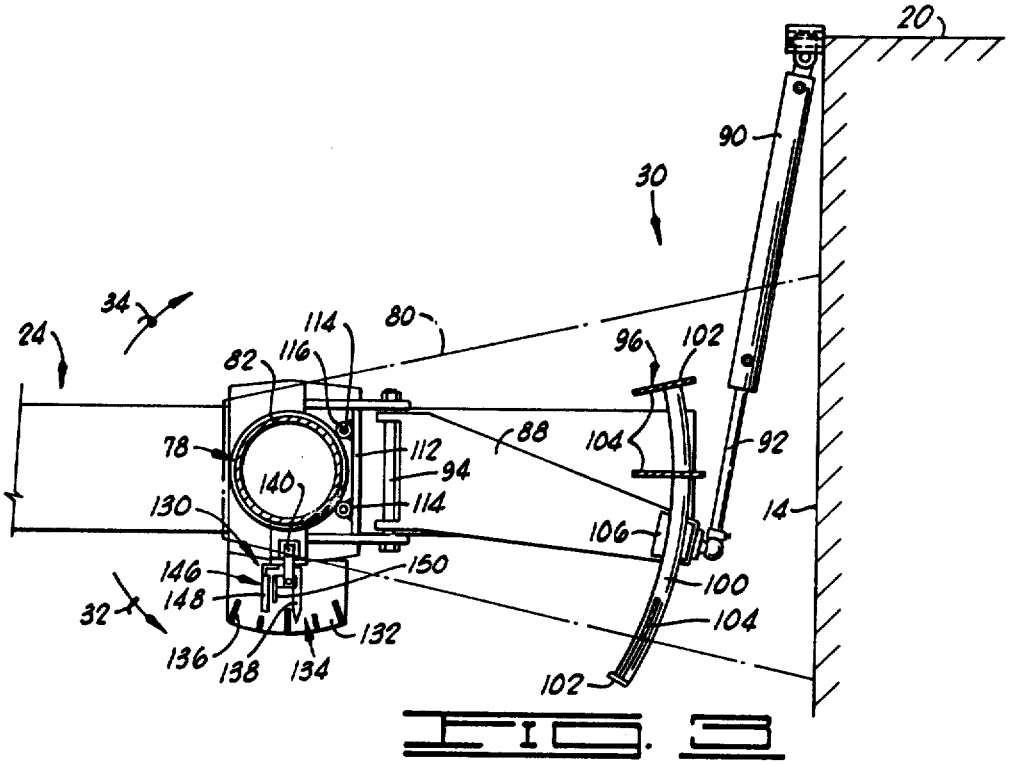
FIG. 3 is an enlarged, partial sectional, top plan view showing a portion of the steering assembly of the trimmer of FIG. 1.

More particularly, one end of the steering arm 88 is pivotally connected to the yoke 86 via a torque arm 94, as shown more clearly in FIGS. 3 and 4. The steering arm 88 is thus pivotally connected to the front track assembly 24 such that the movement thereof in a generally horizontal plane imparts steering movement to the front track assembly 24 via the interconnection therebetween, and yet such that the steering orientation of the front track assembly 24 remains fixed when the main frame 12 is raised and lowered relative to the front track assembly 24 due to the pivotal interconnection between the steering arm 88 and the yoke 86. The steering arm 88 thus controls the steering position of the front track assembly 24 in a positive manner as the steering arm 88 is moved in a generally horizontal plane, while vertical movement between the main frame 12 or, more particularly, the support extension 80 thereof and the front track assembly 24 is independently and automatically controlled via the front elevation positioning assembly 76, as will be described in greater detail below.

The steering assembly 30 also includes a steering arm guide 96 which is connected to the support extension 80 and has a guide portion 98 shaped to receive the end portion of the steering arm 88 connected to the steering cylinder 90. More particularly, the guide portion 98 includes a pair of vertically spaced guide members 100, each guide member 100 being generally acutely formed in one elevation thereof, as shown more clearly in FIG. 3. The guide members 100 are connected via a pair of end members 102, each end member 102 being disposed generally adjacent one end of each guide member 100 and secured thereto to provide the interconnection therebetween. The steering arm guide 96 and, more particularly, one of the guide members 102 thereof is secured to a lower portion of the support extension 80 via a plurality of interconnecting supports 104.

The steering arm guide 96 and, more particularly, the space between the guide members 100 thereof defines a guide path for confining the horizontally oriented steering movement of the steering arm 88 and for maintaining the end of the steering arm 88 connected to the steering cylinder 90 in a predetermined vertical position during the operation of the steering assembly 30. As shown more clearly in FIGS. 3 and 4, the end of the steering arm 88, opposite the end thereof connected to the yoke 86, extends between the guide members 100 of the steering arm guide 96 and a wear pad 106 is secured to an upper and a lower portion of the steering arm 88, each of the wear pads 106 engaging one of the guide members 100 during the operation of the steering assembly 30.

Figure 5:
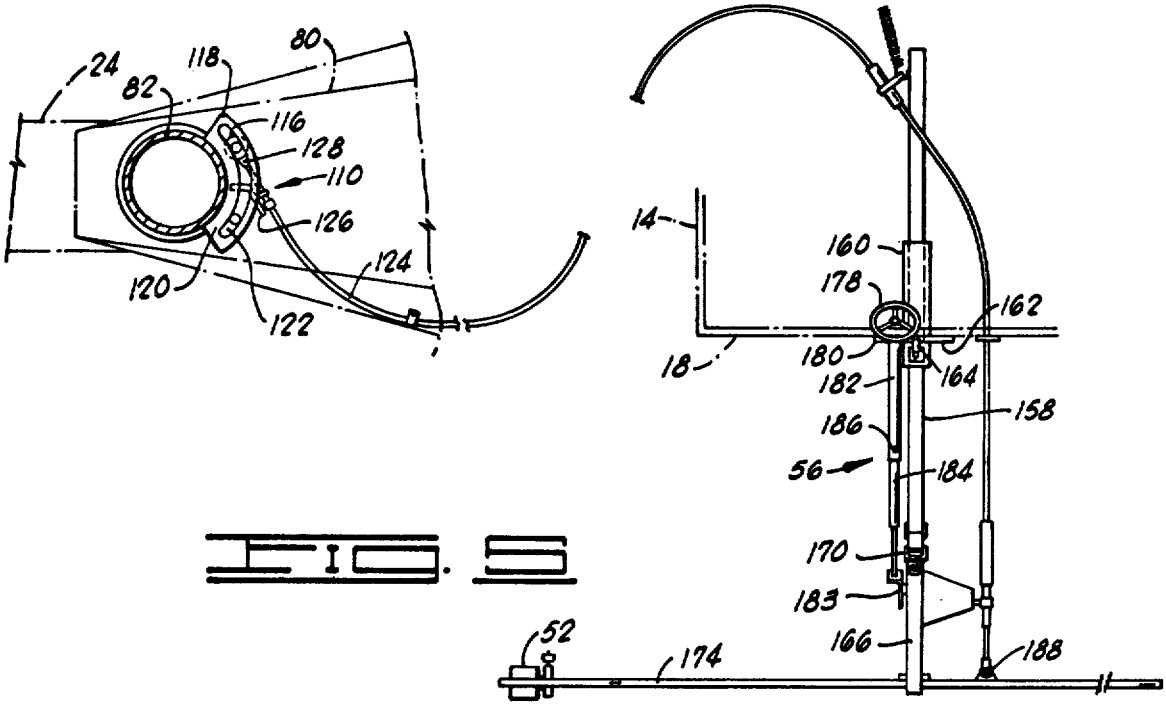
FIG. 5 is an enlarged, fragmentary, partial sectional, top plan view showing a portion of the steering assembly and a portion of the front sensor support of the trimmer of FIG. 1.
Figure 6:
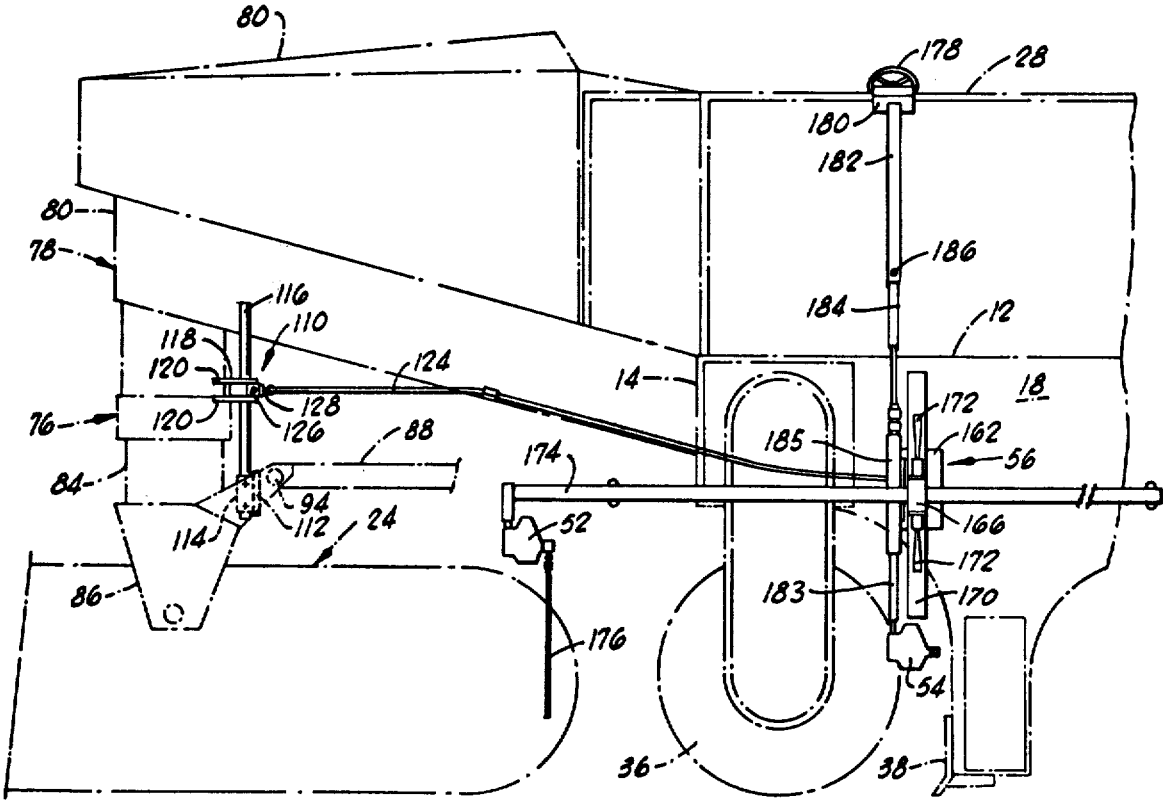
FIG. 6 is an enlarged, fragmentary, side elevational view showing a portion of the steering assembly and a portion of the front sensor support of the trimmer of FIG. 1.

The steering assembly 30, as shown in FIGS. 5 and 6 includes a feedback assembly 110 which is connected to the front track assembly 24 and has a portion thereof connected to the front sensor support 56. The feedback assembly 110 senses the turning position of the front track assembly 24 and provides an output signal in response to rotation thereof, in a manner which will be made more apparent below.

The feedback assembly 110 includes a rod clamp 112 which is secured to the yoke 86, as shown more clearly in FIG. 3. A pair of cylindrically shaped tubes 114 are secured to the rod clamp 112, the tubes 114 being horizontally spaced and having an aperture therethrough sized to receive one end portion of a rod 116. In an assembled position of the feedback assembly 110, one end portion of the rod 116 is disposed through the aperture portion of one of the tubes 114, the rod 116 being securedly positioned therein. The rod 116 is thus securedly connected to the yoke 86 of the front track assembly 24 and extends a distance generally vertically therefrom. It will be apparent from the foregoing that, as the front track assembly 24 is turned, the rod 116 will be moved in response to the turning movement of the front track assembly 24, for reasons which will be made apparent below.

A rod guide 118 is securedly connected to the main frame 12 via the support extension 80 or, more particularly, to a portion of the first housing 82, as shown more clearly in FIG. 6. The rod guide 118 includes a pair of vertically spaced guide supports 120, each guide support 120 having an arcuately shaped aperture 122 formed therethrough, as shown more clearly in FIG. 5. The end of the rod 116, opposite the end thereof connected to one of the tubes 114, extends vertically upwardly from the yoke 86 through the apertures 122 of the rod guide 118.

In the assembled position of the rod guide 118, the apertures 122 through each of the guide supports 120 are aligned, and the apertures 122 define a guide path for confining the movement of the rod 116 to an arcuately shaped path responsively following the steering position of the front track assembly 24, in a manner to be made more apparent below.

The feedback assembly 110 also includes a push-pull cable 124 having a portion thereof securedly connected to the rod guide 118 via a cable support 126. One end of the push-pull cable 124 is connected to the rod 116 via a journal connector 128, the journal connector providing an interconnection between the rod 116 and the push-pull cable 124, such that a portion of the push-pull cable 124 is moved and positioned in response to the movement of the rod 116. The position of the rod 116 thus controls the position of the control portion of the push-pull cable 124, and the position of the control portion of the push-pull cable 124 which is thus indicative of the steering position of the front track assembly 24, is communicated to the front sensor support 56 via the push-pull cable 124.

As shown more clearly in FIGS. 3 and 4, the steering assembly 30 also includes a steering position indicator 130 having an indicator 132 and a pointer assembly 134 which are constructed to provide a visual indication of the steering position of the front track assembly 24 during the operation of the trimmer 10. The indicator 132 is connected to the yoke 86 of the front track assembly 24, the indicator 132 being turned in conjunction with the front track assembly 24. The indicator 132 extends a distance generally horizontally therefrom and a plurality of gradations 136 are printed on the upper portion of indicator 132, the gradations 136 being spaced on the indicator 130 to indicate the turning position of the front track assembly 24, in a manner which will be made more apparent below.

The pointer assembly 134 includes a pointer 138 which is securedly connected to one end of a pointer rod 140, the pointer 138 being positioned in close proximity to the indicator 132 such that the position of the pointer 138 relative to the indicator 132 is indicative of the turning position of the front track assembly 24. The pointer rod 140 is telescoped through an opening formed through a pointer housing 142 such that the pointer rod 140 remains in a fixed elevation during the raising and lowering of the main frame 12. The pointer housing 142 is secured to the front track support assembly 78 and, more particularly, to the first housing 82. As shown more clearly in FIG. 4, a roller 144 is rollingly supported on one end of the pointer rod 140, the roller 144 rollingly contacting the upper portion of the indicator 132 providing a movable contact and reducing the friction therebetween, during the operation of the steering position indicator 130.

As shown in FIGS. 3 and 4, an elevation indicator 146 is connected to the front track assembly 24 and, more particularly, an elevation scale 148 having a plurality of gradation indications thereof is securedly connected to the first housing 82 of the front track support assembly 78. An elevation pointer 150 is securedly affixed to the pointer rod 140 and positioned in close proximity to the elevation scale 148. The raising and lowering of the main frame 12 via the front elevation positioning assembly 76 thus raises and lowers the elevation scale 148 and the position of the elevation pointer 150 relative to the elevation scale 148 is thus indicative of the elevation position of the main frame 12 with respect to the front track assembly 24.

The steering assembly 30 is constructed to automatically steer the trimmer 10 by steeringly moving the front track assembly 24 in response to the output signal of the track steering sensor 52 and the front elevation positioning assembly 76 is constructed to automatically position the main frame 12 in predetermined elevation positions relative to the front track assembly 24 in response to the output signal of the front elevation positioning assembly 76. It should also be noted that the steering position indicator 130 is disposed with respect to the control console 27 to provide a visual indication of the steering position of the trimmer 10, and the elevation indicator 146 is also disposed with respect to the control console 27 to provide a visual indication of the elevation position of the main frame 12 relative to the front track assembly 24.

SENSOR SUPPORT

Figure 7:
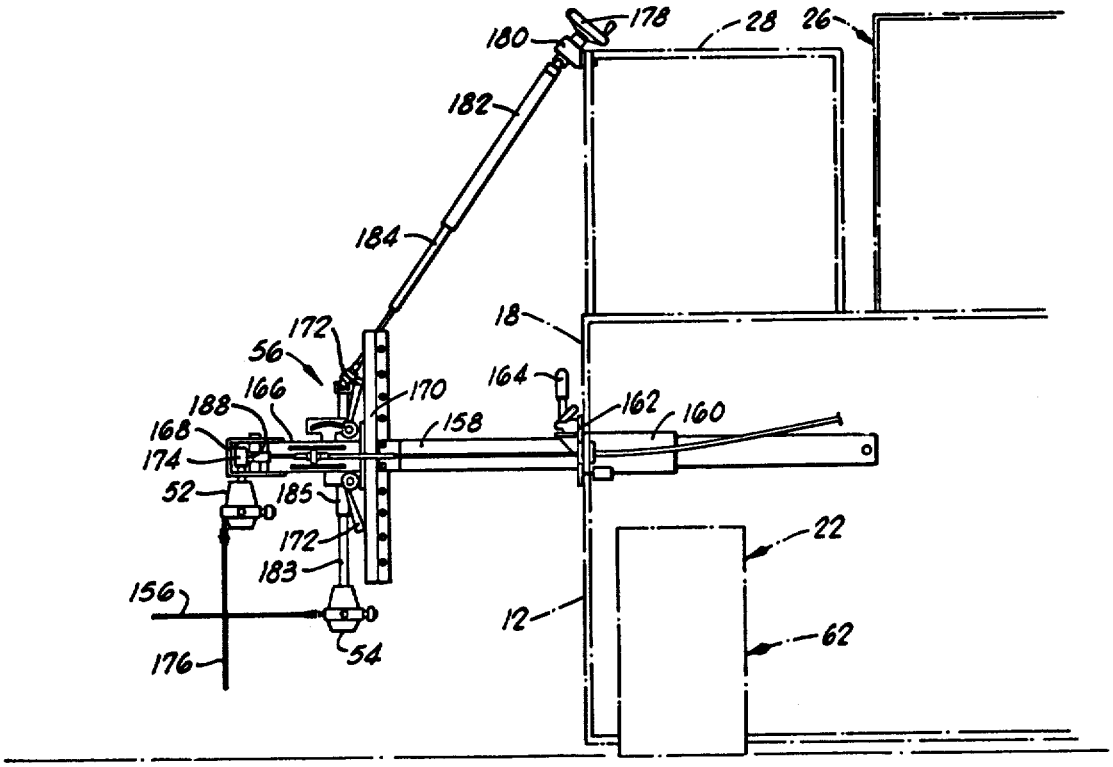
FIG. 7 is an end elevational view of the sensor support of FIGS. 5 and 6.

The track steering sensor 52 and the elevation sensor 54 are adjustably supported on the main frame 12 via the front sensor support 56, as shown more clearly in FIGS. 5, 6 and 7. The elevation sensor 54 has a sensor arm 156 connected thereto and extending generally horizontally therefrom, as shown more clearly in FIG. 7. The elevation sensor 54 is supported on the outer end of a support bar 158, the support bar 158 being movably positionable through an opening in a support housing 160. The support housing 160 is securedly connected to the main frame 12 via an interconnecting flange 162.

A toggle clamp 164 is pivotally connected to the support housing 160, the clamp 164 being pivotable to a locking position, as shown in FIGS. 5 and 7, and a release position (not shown). In the locking position, a portion of the clamp 164 engages an adjacent portion of the support bar 158 to secure the support bar 158 in the support housing 160 and, in the release position, the clamp 164 is disengaged from the support bar 158, so that the support bar 158 is movable in the support housing 160 to controlled positions with respect to the main frame 12.

A flange housing 166 is connected to the track steering sensor 52 end of the support bar 158, an opening 168 being formed through the flange housing 166, as shown more clearly in FIG. 7. The sensor 52 is, more particularly, securedly supported on the flange housing 166, the flange housing 166 forming an adjustable extension of the support bar 158, in a manner which will be made more apparent below.

As shown more clearly in FIG. 5, the flange housing 166 is slidingly and adjustingly disposed in a slot formed through a flange support 170, the flange support 170 being secured to the outermost end of the support bar 158 and the flange housing 166 being, more particularly, connected to the flange support 170 via the sliding interconnection therebetween. As shown more clearly in FIG. 6, a pair of toggle clamps 172 are pivotally connected to the flange housing 166, one of the toggle clamps 172 being connected to the upper side of the flange housing 166 and one of the toggle clamps 172 being connected to the lower side of the flange housing 166.

Each toggle clamp 172 is pivotable to a locking position, as shown in FIG. 6, and a release position (not shown), the toggle clamps 172 each being constructed similar to the toggle clamp 164, described above. A portion of each toggle clamp 172 engages an adjacent portion of the flange support 170 in the locking positions thereof, and each toggle clamp 172 is disengaged from the flange support 170 in a release position thereof. Thus, in a release position of the toggle clamps 172, the flange housing 166 is movable in a vertically upwardly and vertically downwardly direction to position the track steering sensor 52 and the elevation sensor 54 in predetermined horizontal planes.

As shown in FIGS. 5, 6 and 7, the track steering sensor 52 is, more particularly, secured to one end of a support bar 174, the support bar 174 extending through the opening 168 formed in the flange housing 166. The support bar 174 is thus movably positionable within the flange housing 166, and is secured in a predetermined position therein via a pin or the like (not shown) during the operation of the trimmer 10.

A handwheel 178 is journally connected to a portion of the guard rail 28 of the main frame 12 via a journal support 180. The handwheel 178 is connected to one end of an extension shaft 182 and the opposite end of the extension shaft 182 is pivotally connected to the support member 183, the support member 183 being connected to the elevation sensor 54. More particularly, the extension shaft 182 includes a threaded extension member 184, one end of the extension member 184 being pivotally connected to the support member 183. The support member 183 is movably disposed within a housing 185 which is secured to a portion of the flange housing 166 such that the support member 183 can be moved upwardly and downwardly within the housing 185. The extension shaft 182 and the extension member 184 are each constructed and connected to the handwheel 178 such that as the handwheel 178 is rotated, the support member 183 is moved upwardly and downwardly within the housing 185 or, in other words, raised and lowered with respect to the main frame 12, the upward and downward movement of the support member 183 being determined by the direction of rotation of the handwheel 178. Thus, the elevation sensor 54 connected to the support member 183 can be raised and lowered with respect to the main frame 12 from a remote position located on the main frame 12 by rotating the handwheel 178.

As shown in FIGS. 5 and 6, a set screw 186 can be threaded through the extension shaft 182 and into engagement with the extension member 184 to secure the sensor support 56 in one position. However, in a preferred form, the threaded engagement between the extension shaft 182 and the extension member 184 provides a positive, secure positioning therebetween, and yet permits the sensor support 56 to be threadingly moved inwardly and outwardly from a remote position thereby facilitating the position control of a portion of the sensor support 56 from a remote position.

As shown in FIG. 5, the end of the push-pull cable 124, generally opposite the end thereof connected to the rod 116, is pivotally connected to one end of the support bar 174. The support bar 174, in a preferred form, is pivotally supported in the flange housing 166 such that the push-pull cable 124 pivotally moves the support bar 174, thereby pivotally moving the track steering sensor 52 in response thereto.

As described before, the movement of the push-pull cable 124 is controlled and is responsive to the position of the rod 116 of the feedback assembly 110. Thus as the rod 116 is moved in the rod guide 118 in response to or following the steering movement of the front track assembly 24, the track steering sensor 52 is pivotally positioned in the front sensor support 56. The front sensor support 56 is thus connected to the push-pull cable 124 such that the steering movement of the front track assembly 24 is automatically fed back to the track steering sensor 52 for positive steering control of the trimmer 10 during the operation thereof.

The steering and elevation controls of the trimmer 10 are particularly constructed such that the front sensor support 56 can be supported from the left side 18 of the main frame 12, as described above, or from the right side 20 of the main frame 12. If the front sensor support 56 is to be supported on the right side 20, the sensor support 56 is simply secured to the right side 20, and the rod 116 of the feedback assembly 110 retainingly disposed in the opposite tube 114 than as shown in FIG. 3, the cable support 126 being reoriented 180° so that the push-pull cable 124 extends therefrom generally toward the right side 20 of the main frame 12. This control flexibility is particularly useful in those applications wherein a control reference, such as a string-line, cannot be easily constructed on a particular side of the trimmer 10.

RECLAIMER ASSEMBLY

As mentioned before, the reclaimer assembly 40 of the trimmer 10 includes the base conveyor 42 which has a belt-like conveyor 190 supported via a base frame 192, the base conveyor 42 being supported generally between the left side 18 and the right side 20 and extending angularly generally under the main frame 12, as shown more clearly in FIG. 8. The base conveyor 42 has a receiving end 194 and a disposing end 196, and is disposed and constructed to move the earth excavated by the auger 36 and the moldboard 38 generally toward the disposing end 196 during the operation thereof.

As shown more clearly in FIG. 8, a pair of latching flanges 198 are secured on the end of the base frame 192, generally near the receiving end 194 of the base conveyor 42, each latching flange 198 being, more particularly, secured to one side of the base frame 192 (only one of the latching flanges 198 being shown in FIG. 8). A portion of each latching flange 198 is constructed to be latchingly disposed over a pin 200 which is securedly connected to a portion of the main frame 12. In the assembled position of the base conveyor 42, each latching flange 198 is disposed in a latching position with respect to one of the pins 200 and a locking pin 202 is secured through a portion of the main frame 12, generally above each of the latching flanges 198. Each locking pin 202 engages a portion of each latching flange 198 to secure each latching flange 198 in an assembled position with respect to one of the pins 200.

A jack flange 204 is secured to the underside of the base frame 192, the jack flange 204 extending a distance from the base frame 192. The jack flange 204 is constructed to facilitate the removal of the base conveyor 42, during one aspect of the operation of the trimmer 10, as will be made more apparent below.

The base frame 192 is removably secured to the main frame 12 via a pair of removal pins 206, each removal pin 206 connecting one side of the base frame 192 to the main frame 12 (only one of the removal pins 206 being shown in FIG. 8). The base conveyor 42 is thus removably supported on the main frame 12 via the latching flanges 198, the pins 200, the locking pins 202, the removal pins 206 and the jack flange 204 such that the base conveyor 42 can be easily removed from an assembled position on the trimmer 10, during one aspect of the operation of the trimmer 10. To remove the base conveyor 42, the locking pins 202 are initially removed from the main frame 12, and subsequently each removal pin 206 is removed. After the removal pins 206 have each been removed, the base conveyor 42 is lowered downwardly to a position wherein the jack flange 204 engages an adjacent portion of the earth, the jack flange 204 forming a pivoting base on the base frame 192. As the disposing end 196 of the base conveyor 42 is lowered further each latching flange 198 is pivoted in an upwardly direction via the jack flange 204 to a position wherein each latching flange 198 is disengaged from the respective pin 200. In the unlatched position of the base conveyor 42, as described before, the trimmer 10 can be moved in a generally forward direction, leaving the base conveyor 42 therebehind.

The base conveyor 42 includes a conveyor drive 208 which is drivingly connected to the belt-like conveyor 190, generally near the disposing end 196 thereof, to drive the belt-like conveyor 190 in a direction generally from the receiving end 194 toward the disposing end 196 thereof, in an actuated position of the conveyor drive 208. The belt-like conveyor 194 is, more particularly, of the endless belt type and the conveyor drive 208 is drivingly connected thereto via a drive shaft (not shown) which engages a portion of the conveyor 190, in a manner well known in the art. It should be noted that the designations, above and below, referring to the "receiving end" and the "disposing end" of a conveyor, refer more particularly to relative positions on the conveyor, rather than specific portions thereof, the designations being used merely for the purpose of identification and clarity of description.

As shown more clearly in FIGS. 1, 8 and 9, the receiving end 194 of the base conveyor 42 is disposed generally near the moldboard 38 and, more particularly, the moldboard 38 has an opening 210 formed through a central portion thereof and the auger 36 and the moldboard 38 are each constructed to move the excavated earth generally toward a central portion of the moldboard 38, the excavated earth being then moved through the opening 210 in the moldboard 38 and onto the receiving end 194 of the base conveyor 42. The auger 36, more particularly, has a double-helical flight of cutter blades thereon, the flight of cutter blades on each side of the auger 36 being constructed and shaped to move the excavated earth generally toward a central portion thereof. A guide baffle 212 is secured to the main frame 12 generally about the opening 210 in the moldboard 38 to guide the excavated earth onto the base conveyor 42.

Figure 2:
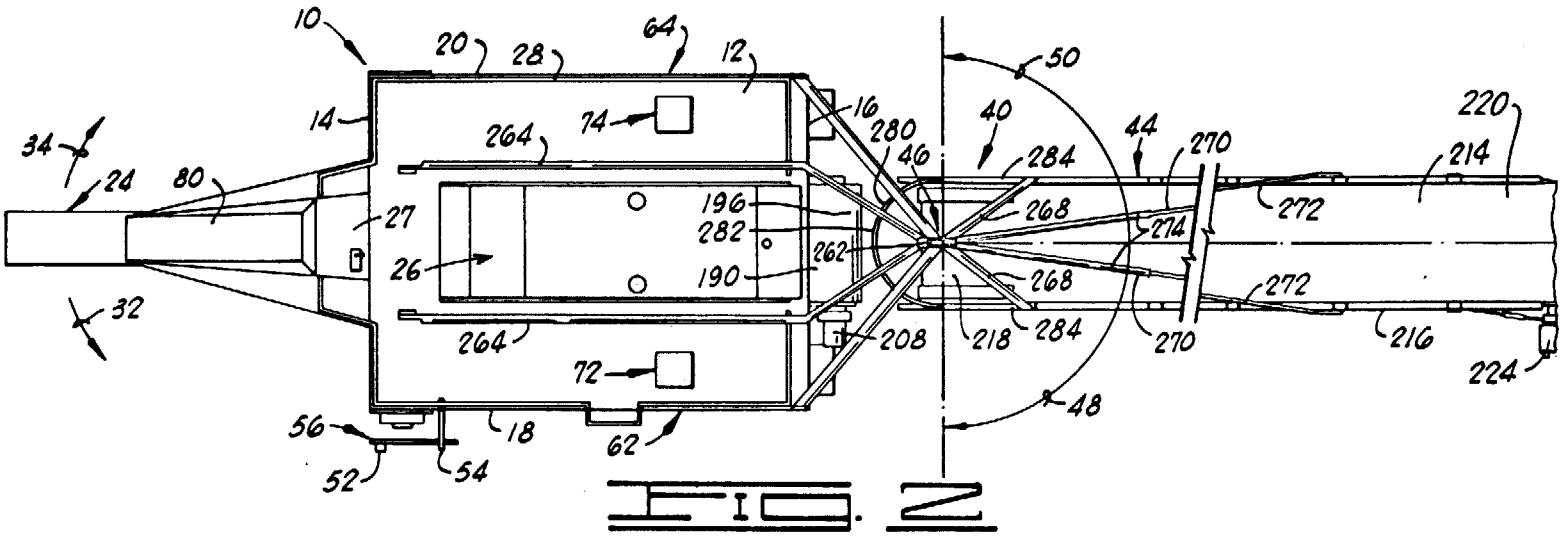
FIG. 2 is a top plan view of the trimmer of FIG. 1.

The elevated conveyor 44 has a belt-like conveyor 214 movably supported on an elevated frame 216, and includes a receiving end portion 218 and a disposing end portion 220, as shown in FIGS. 1, 2 and 8. The elevated conveyor 44 is supported on the rearward end 16 of the main frame 12 via the automatic conveyor positioning support 46, the receiving end 218 of the elevated conveyor 44 being disposed generally near the disposing end 196 of the base conveyor 42, and the elevated conveyor 44 extending generally angularly from the rearward end portion 16 of the trimmer 10. The automatic conveyor positioning support 46 is constructed to support the elevated conveyor 44 in predetermined elevated positions and to automatically position the disposing end 220 of the elevated conveyor 44 in predetermined angular positions generally about a 180 degree swing path, the swing path being generally in a horizontal plane with respect to the trimmer 10, in a manner to be described in greater detail below.

The elevated conveyor 44 also includes a conveyor drive 224 which is drivingly connected to the elevated conveyor 44, generally near the disposing end portion 220 thereof. The conveyor drive 224 is constructed to drive the belt-like conveyor 214 in a direction generally from the receiving end 218 toward the disposing end 220 thereof, in an actuated position of the conveyor drive 224.

The automatic conveyor position control 46 includes a pivotal connecting structure 228 and a swing support 230, the pivotal connecting structure 228 provides the interconnection between the main frame 12 and the elevated conveyor 44, and the swing support 230 provides augmenting structural support for the elevated conveyor 44 during the pivotal movement thereof.

Figure 11:
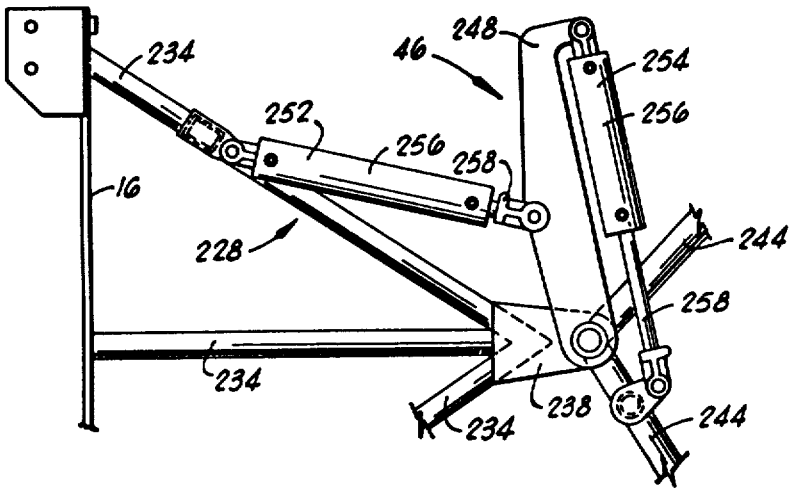
FIG. 11 is a fragmentary, enlarged, top plan view of the conveyor position control of FIGS. 8 and 10.
Figures 1, 2, 3:
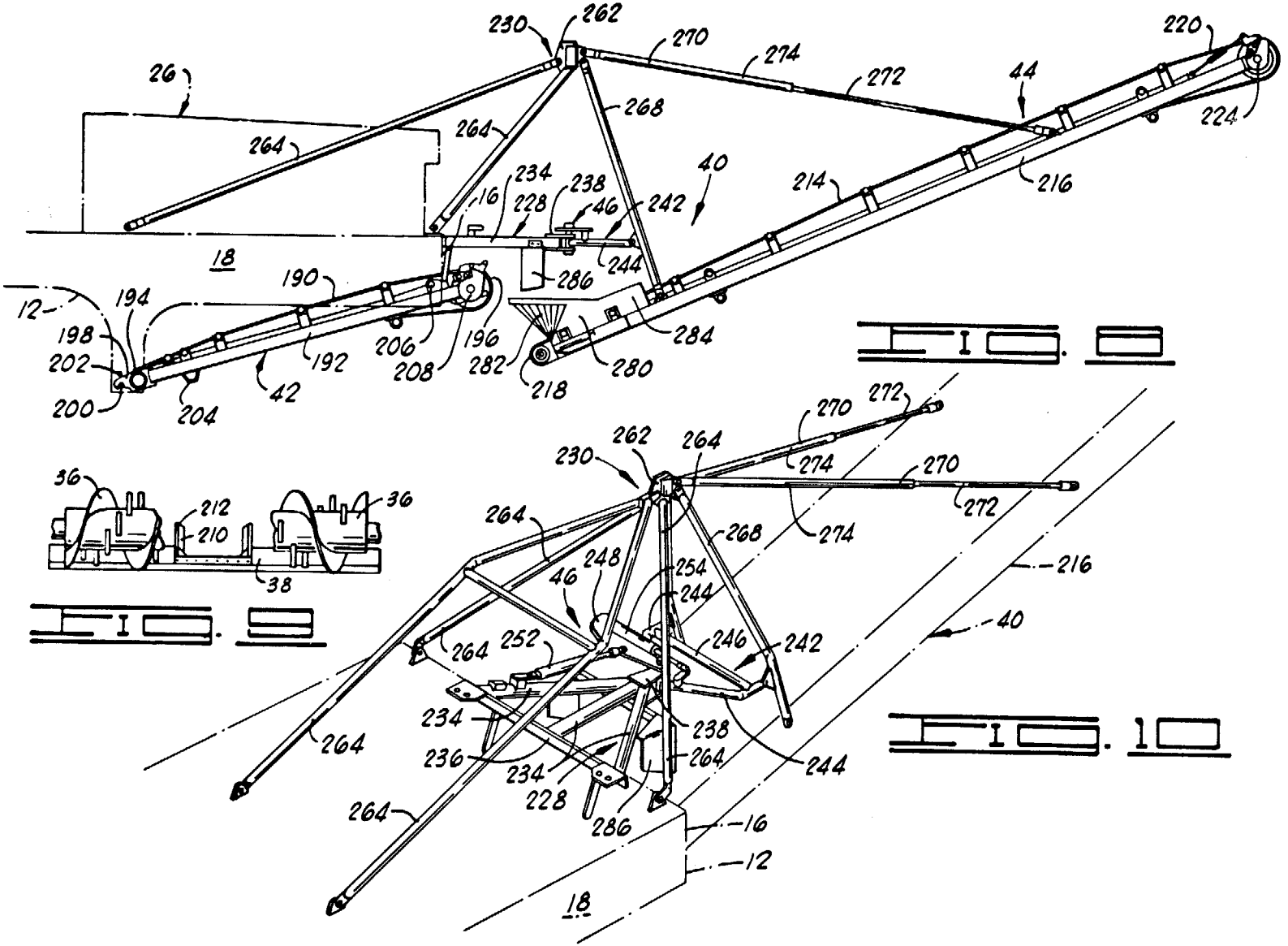

As shown more clearly in FIGS. 10 and 11, the pivotal connecting structure 228 includes three support rods 234, one end of each support rod 234 being connected to a brace flange 236, which is securedly connected to the rearward end 16 of the trimmer 10. Each support rod 234 extends from the rearward end 16 of the trimmer 10, in a generally rearwardly direction, the support rods 234 forming a triangularly shaped support with the end of each support rod 234, opposite the ends thereof connected to the rearward end 16 of the main frame 12, being securedly interconnected. A pivot flange 238 is connected to each of the support rods 234, generally at the interconnection between the support rods 234, the pivot flange 238 extending a distance generally horizontally therefrom.

A pivot support 242 is pivotally connected on one end thereof to the pivot flange 238. The pivot support 242 includes a pair of rod members 244, one end of each rod member 244 being connected to one end of the other rod member 244, and each rod member 244 extending generally angularly from the pivotal interconnection between the pivot support 242 and the pivot flange 238. Each rod member 244 is formed such that the ends thereof, generally opposite the interconnected ends thereof, are each connected to a portion of the swing support 230, thereby providing a pivoting interconnection between the pivotal connecting structure 228 and the swing support 230. A brace member 246 connects the rod members 244 to provide additional structural strength to the swing support 230, during the operation of the automatic conveyor position control 46.

One end of a base flange 248 is pivotally connected to the pivot flange 238, as shown more clearly in FIG. 11. The conveyor position control 46 includes a first conveyor actuator 252 and a second conveyor actuator 254, each being constructed and connected to a portion of the pivotal connecting structure 228 to pivotally move the elevated conveyor 44 in a swing direction 48 and 50, generally 180 degrees about the pivotal interconnection between the elevated conveyor 44 and the trimmer 10. In a preferred form and as shown in FIGS. 10 and 11, the first conveyor actuator 252 and the second conveyor actuator 254 are each hydraulically operated cylinders, each having a cylinder portion 256 and a rod portion 258. The cylinder portion 256 of the first conveyor actuator 252 is pivotally connected to one of the support rods 234 and the rod portion 258 thereof is pivotally connected to the base flange 248. The cylinder portion 256 of the second conveyor actuator 254 is pivotally connected to the base flange 248 and the rod portion 258 thereof is connected to one of the rod members 244. The first conveyor actuator 252 and the second conveyor actuator 254 are connected in hydraulic parallel to balance the load imposed on the actuators 252 and 254, during the operation of the automatic conveyor position control 46, as will be described in greater detail below.

The swing support 230 includes a pivot base 262 structurally connected to and supported by the main frame 12 via a plurality of support members 264 as shown in FIGS. 1, 2, 8 and 10. One end of each support member 264 is connected to the main frame 12 and the end of each support member 264, opposite the end thereof connected to the main frame 12, is connected to the pivot base 262, the support members 264 thereby supporting the pivot base 262 generally vertically above the main frame 12 and above a portion of the elevated conveyor 44. The elevated conveyor 44 is pivotally connected to the pivot base 262 via a plurality of conveyor support members 268, one end of each conveyor support member 268 being connected to a portion of the pivot base 262 for pivotal movement thereabout during the operation of the automatic conveyor position control 46.

As shown more clearly in FIGS. 8 and 10, the ends of two of the conveyor support members 268, opposite the ends thereof connected to the pivot base 262, are pivotally secured to a portion of the elevated frame 216, one conveyor support member 268 being secured to one side of the elevated frame 216 and the other conveyor support member 268 being secured generally to the opposite side of the elevated frame 216. The rod members 244 are thus, more particularly, connected to the conveyor support members 268.

The swing support structure 230 also includes a pair of telescoping supports 270, one end of each telescoping support 270 being pivotally secured to one side of the elevated frame 216, and the opposite end of each telescoping support 270 being pivotally secured to a portion of the pivot base 262 for pivotal movement thereabout. The two telescoping supports 270, more particularly, support the elevated conveyor 44 in a particular, predetermined, angular, elevated position, the angularly elevated position of the elevated conveyor 44 being adjustable to predetermined positions via the telescoping supports 270. Each of the telescoping supports 270 comprise a rod portion 272 and a hollow portion 274, each rod portion 272 being telescoped within one of the hollow portions 274.

As shown more clearly in FIGS. 1, 2 and 8, a funnel member 280 having a funnel portion 282 and side supports 284 is connected to the elevated frame 216 of the elevated conveyor 44, generally near the receiving end portion 218 thereof. Each side support 284 is connected to one side of the elevated frame 216, each side support 284 extending a distance generally from the receiving end portion 218 toward the disposing end portion 220 of the elevated conveyor 44 and extending a distance vertically upwardly from the elevated frame 216. A guide plate 286 is secured to the pivotal connecting structure 228 and extends a distance vertically downwardly therefrom. The guide plate 286 thus remains in a fixed position relative to the base conveyor 42, and the guide plate 286 and the side supports 284 cooperate with the funnel portion 282 to funnelingly channel the excavated earth from the base conveyor 42 onto the receiving end portion 218 of the belt-like conveyor 214 during the operation of the base conveyor 42 and the elevated conveyor 44.

MOLDBOARD WING ASSEMBLY

Figure 12:
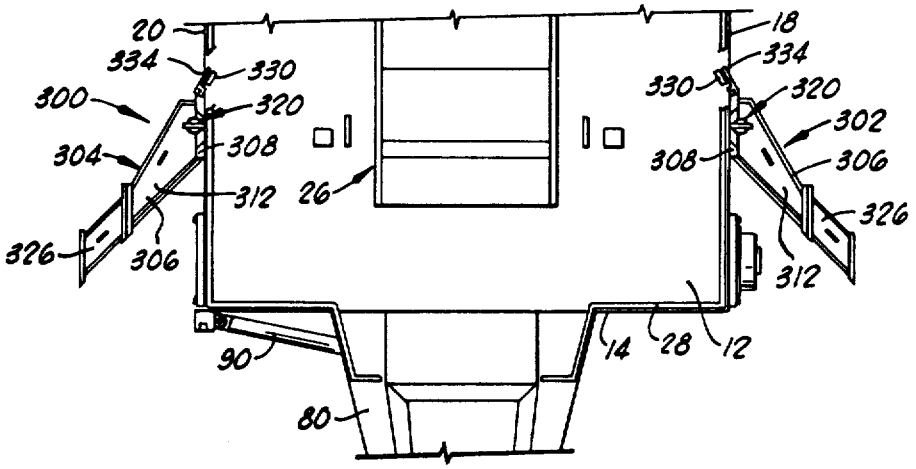
FIG. 12 is a fragmentary, top plan view showing the moldboard wing assembly utilized with the trimmer of FIG. 1, in one aspect of the operation thereof.
Figure 13:
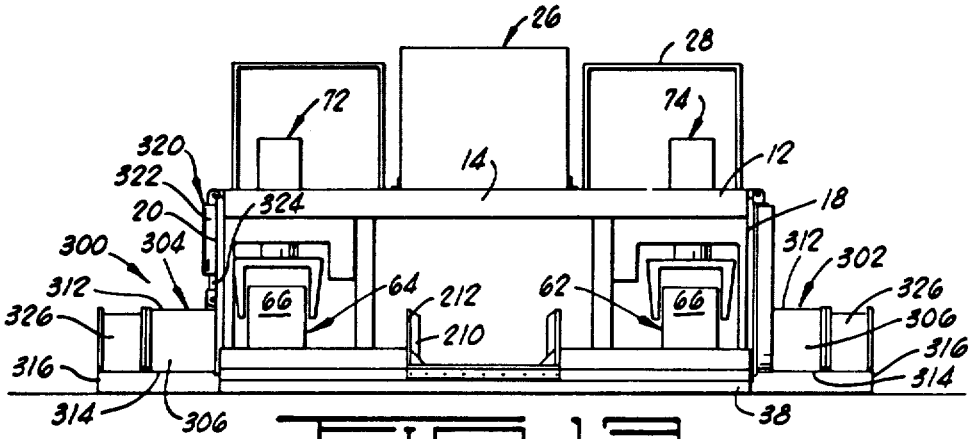
FIG. 13 is a partial front elevation, partial sectional view showing the moldboard wing assembly of FIG. 12.
Figure 14:
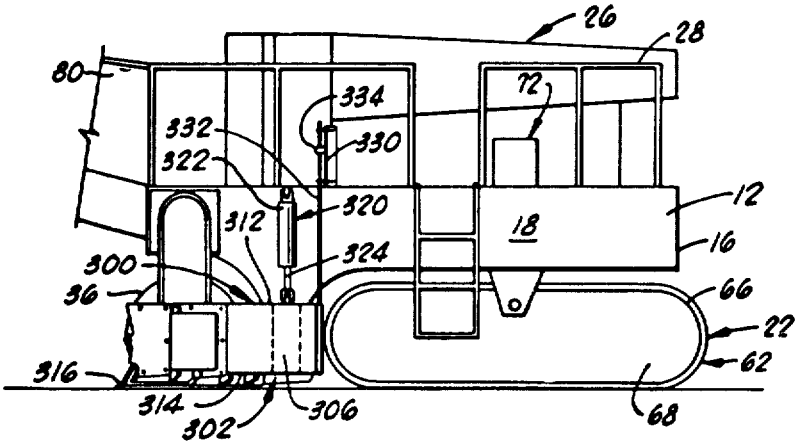
FIG. 14 is a fragmentary, side elevational view of the moldboard wing assembly of FIG. 12.

In one form, as shown in FIGS. 12, 13 and 14, the trimmer 10 includes a moldboard wing assembly 300 basically comprising a left moldboard wing 302 and a right moldboard wing 304, the left moldboard wing 302 being removably and adjustably connected to the left side 18 of the main frame 12 generally near the moldboard 38, and the right moldboard wing 304 being removably and adjustably connected to the right side 20 of the main frame 12 generally near the moldboard 38. The left moldboard wing 302 and the right moldboard wind 304 each extend angularly from the main frame 12 and provide an additional excavating width capacity of the trimmer 10, during one aspect of the operation thereof.

The left moldboard wing 302 and the right moldboard wing 304 each include a wing member 306 having one side thereof channelingly connected to a channel member 308, one channel member 308 being securedly connected to each side 18 and 20 of the main frame 12. The channeling interconnection between the wing members 306 and the main frame 12 is constructed such that each wing member 306 is movable in a vertically upwardly direction to a storage position and in a vertically downwardly direction toward an earth-engaging position.

Each wing member 306 has an upper base 312 and a lower base 314, a blade 316 being connected to each of the lower bases 314, as shown more clearly in FIGS. 13 and 14. A wing actuator 320 is connected to each of the wing members 306 and, more particularly, to the upper base 312 thereof. The wing actuator 320 is, in a preferred form, a hydraulically operated cylinder having a cylinder portion 322 and a rod portion 324, each cylinder portion 322 being connected to one of the sides 18 and 20 of the main frame 12 and each rod portion 324 being connected to the upper base 312 of one of the wing members 306. The wing actuators 320 are thus connected to the main frame 12 and to the wing members 306 to raise and lower each of the wing members 306, in an actuated position of the wing actuator 320 connected thereto.

As shown more clearly in FIGS. 12 and 13, the moldboard wing assembly 300 also includes a pair of wing extension members 326, each of the wing extension members 326 being removably connected to one of the wing members 306. Each wing extension member 326 is, more particularly, bolted on one end thereof to the end of one of the wing members 306, opposite the end thereof channelingly connected to the main frame 12. The wing extension members 326 cooperate to provide an additional excavating width capacity for the trimmer 10, during one aspect of the operation thereof.

In a preferred form, the trimmer 10 also includes a pair of wing scales 330, one of the wing scales 330 being supported on the left side 18 of the main frame 12, generally near the forward end 14 thereof, and the other wing scale 330 being supported on the right side 20 of the main frame 12, generally near the forward end 14 thereof. As shown more clearly in FIG. 14, each wing scale 330 (only one wing scale 330 being shown in FIG. 14) extends generally vertically upwardly from the main frame 12, and a scale rod 332 having a pointer 334 secured thereto is movably disposed adjacent to each of the wing scales 330. One end of each of the scale rods 332 is secured to the upper base 312 of one of the wing members 306. Each scale rod 332 is thus moved vertically upwardly and downwardly as the wing actuators 320 are actuated to move the moldboard wing assembly 300 in a vertically upwardly and a vertically downwardly direction, the position of each pointer 334, relative to one of the wing scales 330 thereby indicating the elevated position of the left moldboard wing 302 and the right moldboard wing 304, during the operation of the moldboard wing assembly 300.

TRIMMER CONTROL APPARATUS

As mentioned before, the left elevation positioning assembly 72, the right elevation positioning assembly 74 and the front elevation positioning assembly 76 are each constructed to automatically position the trimmer 10 in controlled, predetermined grade and slope positions during the operation thereof. More particularly, the control apparatus of the trimmer 10 is constructed such that the left elevation positioning assembly 72 and the right elevation positioning assembly 74 can each be manually actuated to predetermined elevation positions or such that the left elevation positioning assembly 72 and the right elevation positioning assembly 74 can be automatically controlled, in a manner diagrammatically and schematically shown in FIG. 15.

Figure 15:
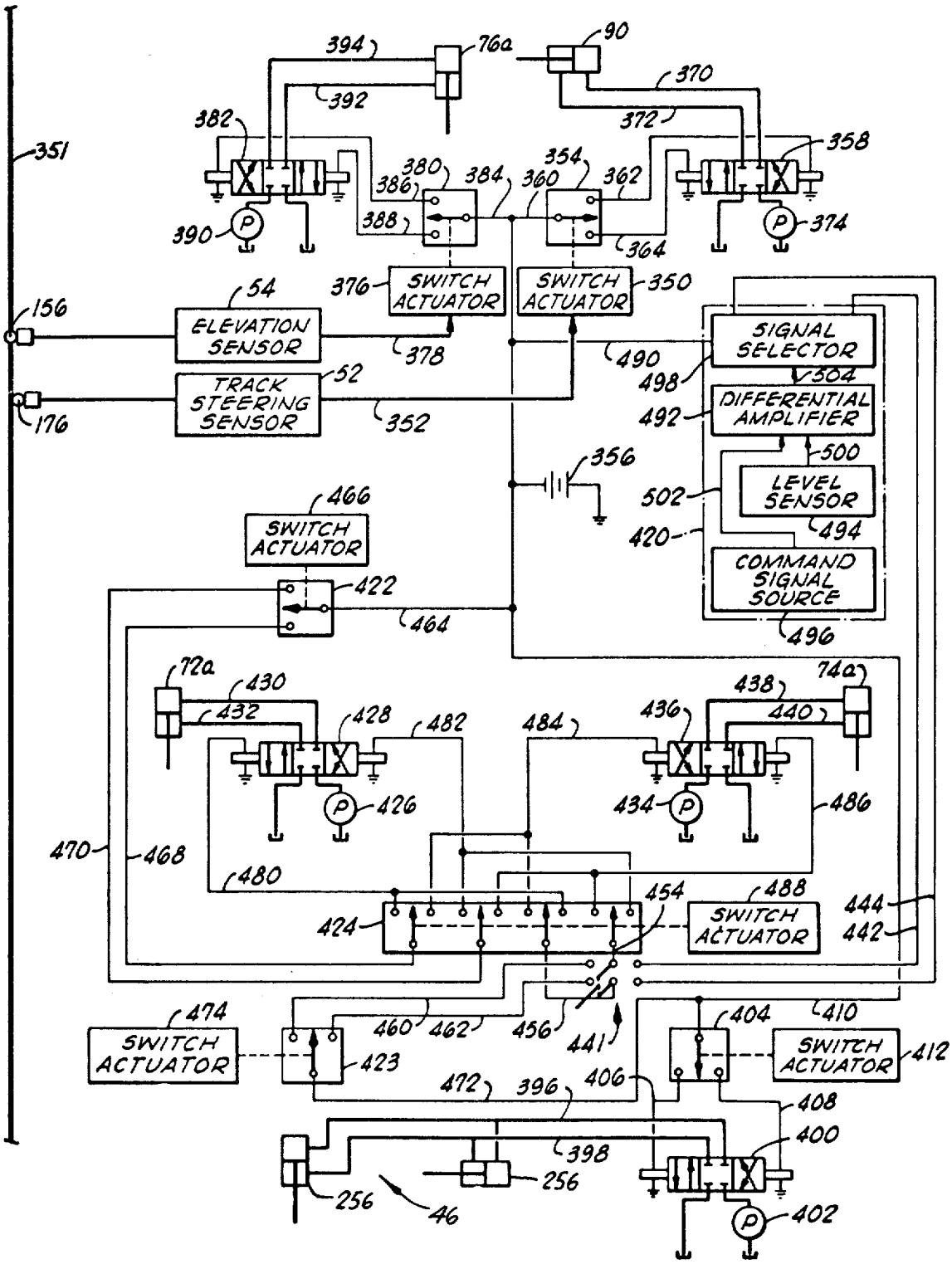
FIG. 15 is a partial diagrammatical, partial schematic view showing a portion of the control apparatus of the trimmer of FIG. 1.

As shown in FIG. 15, a switch actuator 350 is connected to the track steering sensor 52, the switch actuator 350 being constructed to receive an output signal 352 from the track steering sensor 52. The output signal 352 is responsive to the sensed position of the main frame 12 relative to a control reference, the control reference being diagrammatically shown in FIG. 15 and designated by the numeral 351.

The switch actuator 350 is connected to a switch 354, the switch 354 being interposed between an energizing power supply 356 and a solenoid-operated control valve 358. More particularly, a conductor 360 connects the switch 354 to the energizing power supply 356, and a pair of conductors 362 and 364 provide the electrical interconnection between the switch 354 and the control valve 358. The switch 354 is, more particularly, a two-position switch, the switch 354 providing electrical communication between the energizing power supply 356 and the control valve 358 via the conductors 360 and 362 in one position thereof, and providing electrical communication between the energizing power supply 356 and the control valve 358 via the conductors 360 and 364 in one other position thereof.

The steering cylinder 90 is connected to the control valve 358 via a pair of conduits 370 and 372, the control valve 358 being interposed generally between the steering cylinder 90 and a pump 374. The control valve 358 is constructed to provide fluidic communication between the pump 374 and the steering cylinder 90 via the conduit 370, in one energized position thereof, and to provide fluidic communication between the pump 374 and the steering cylinder 90 via the conduit 372, in one other energized position thereof.

The switch actuator 350 thus controls the position of the switch 354 in response to the output signal 352 of the track steering sensor 52, thereby controlling the energized position of the control valve 358. The control valve 358 establishes fluidic communication between the pump 374 and the steering cylinder 90 in response to the output signal 352 of the track steering sensor 52 to actuate the steering cylinder 90 to move the front track assembly 24 in a steering direction 32 and 34 in response to the output signal 352 of the track steering sensor 52 to maintain the steering position of the trimmer 10 relative to the control reference 351.

A switch actuator 376 is connected to the elevation sensor 54, the switch actuator 376 being constructed to receive an output signal 376 from the elevation sensor 54, and to actuate a switch 380 in response thereto. The switch 380 is interposed between a solenoid-operated control valve 382 and the energizing power supply 356. More particularly, the energizing power supply 356 is connected to the switch 380 via a conductor 384, and the switch 380 is connected to the control valve 382 via a pair of conductors 386 and 388. The switch 380 is constructed to provide electrical communication between the power supply 356 and the control valve 382 via the conductors 384 and 386, in one position thereof, and to provide electrical communication between the power supply 356 and the control valve 382 via the conductors 384 and 388, in one position thereof.

The control valve 382 is interposed between the front elevation positioning assembly 76, referred to below simply as the front elevation cylinder, schematically and diagrammatically shown in FIG. 14 and referenced therein by the reference numeral **76*a*, and a pump 390. More particularly, the front elevation cylinder 76*a* is connected to the control valve 382 via a pair of conduits 392 and 394, and the control valve 382 is constructed to provide fluidic communication between the pump 390 and the front elevation cylinder 76*a* via the conduit 392, in one position thereof, and to provide fluidic communication between the pump 390 and the front elevation cylinder 76*a* via the conduit 394**, in one other position thereof.

The switch actuator 376 thus controls the position of the switch 380 in response to the output signal 378 of the elevation sensor 54, the switch actuator 376 thereby controlling the position of the control valve 382. The control valve 382 thus establishes fluidic communication between the pump 390 and the front elevation cylinder **76*a* to raise and lower the main frame 12 in response to the output signal 378 of the elevation sensor 54**.

The cylinder portions 256 of the conveyor position control 46 are each connected in hydraulic parallel via a pair of conduits 396 and 398, as shown schematically in FIG. 15. The conduits 396 and 398 are each connected to a control valve 400, the control valve 400 being interposed between the wing actuator 320 and a pump 402.

The control valve 400 is, more particularly, a solenoid-operated control valve, the control valve 400 being connected to a switch 404 via a pair of conductors 406 and 408. The switch 404 is connected to the power supply 356 via a conductor 410, the switch 404 being interposed generally between the power supply 356 and the control valve 400. A switch actuator 412 is mechanically connected to the switch 404 to position the switch 404 to provide electrical communication between the power supply 356 and the control valve 400 via the conductors 410 and 408, in one position of the switch 404, and to establish an electrical communication between the power supply 356 and the control valve 400 via the conductors 410 and 406, in one other actuated position of the switch 404.

The control valve 400 thus establishes fluidic communication between the conveyor position control 46 and the pump 402 via a conduit 396 in one energized position thereof, and establishes fluidic communication between the pump 402 and the conveyor position control 46 via a conduit 398 in one other energized position thereof. The switch actuator 412 thus energizes the control valve 400 to swing the elevated conveyor 44 in a swing direction 48 and 50 to predetermined, controlled positions and, since the cylinder portions 256 are in hydraulic parallel, each cylinder 256 acts to move the elevated conveyor 44 in an actuated position of the switch 404, the cylinder portion 256 having the least load imposed thereon providing the greater swinging power. The conveyor position control 48 is thus connected such that the imposed load on each cylinder portion 256 is essentially balanced between the cylinder portions 256 to move it in the swing directions 48 and 50 in a more efficient and economical manner.

The elevation of the rearward end 16 of the trimmer 10 is controlled via the left elevation positioning assembly 72 and the right elevation positioning assembly 74. The left elevation positioning assembly 72 and the right elevation positioning assembly 74 each include a hydraulic cylinder, as mentioned before, the hydraulic cylinders being diagrammatically shown in FIG. 15 and designated therein by the reference numerals **72*a* and 74*a*, respectively. The controls of the trimmer 10 are constructed such that the left hydraulic cylinder 72*a* and the right hydraulic cylinder 74*a* are controlled via switches 420, 422, 423 and 424**.

A pump 426 is connected to the left hydraulic cylinder **72*a* via a control valve 428, the left hydraulic cylinder 72*a* being connected to the control valve 428 via a pair of conduits 430 and 432. The control valve 428 is, more particularly, a solenoid-operated type control valve having one energized position wherein fluidic communication is established between the pump 426 and the left hydraulic cylinder 72*a* via the conduit 430 and one other energized position wherein fluidic communication is established between the pump 426 and the left hydraulic cylinder 72*a* via the conduit 432**.

A pump 434 is connected to the right hydraulic cylinder **74*a* via a control valve 436, the control valve 436 being connected to the right hydraulic cylinder 74*a* via a pair of conduits 438 and 440. The control valve 436 is a solenoid-operated control valve having one energized position wherein fluidic communication is established between the pump 434 and the right hydraulic cylinder 74*a* via the conduit 438 and one other energized position wherein fluidic communication is established between the pump 434 and the right hydraulic cylinder 74*a* via the conduit 440**.

The switch 420 is connected to a switch 441 via a pair of conductors 422 and 444. The switch 441 is a three-position switch having a disconnect position, as schematically shown in FIG. 15, and one actuated position wherein the conductors 442 and 444 are connected to the switch 424 via a pair of conductors 454 and 456, and one other actuated position wherein the switch 423 is connected to the switch 424 via a pair of conductors 460 and 462 and the conductors 454 and 456. The switch 441 thus selectively establishes electrical communication between the switch 424 and the switch 420 or the switch 423, for reasons which will be made more apparent below.

The switch 422 is connected to the power supply 356 via a conductor 464 and has a switch actuator 466 connected thereto. The switch 422 is connected to the switch 424 via a pair of conductors 468 and 470, the switch actuator 466 being constructed to position the switch 422 in one position wherein electrical communication is established between the conductors 464 and 468 and one other position wherein electrical communication is established between the conductors 464 and 470.

The switch 423 is connected to the power supply 356 via a conductor 472 and has a switch actuator 474 connected thereto, the switch 423 being constructed to establish electrical communication between the conductor 472 and the conductor 460 in one actuated position of the switch 423 and to establish electrical communication between the conductor 472 and the conductor 462 in one other actuated position of the switch 423.

The switch 424 is connected to the control valve 428 via conductors 480 and 482, and is connected to the control valve 436 via conductors 484 and 486. The switch 424 is actuated via a switch actuator 488, in a manner and for reasons which will be made more apparent below.

The switch 420 is, more particularly, a cross slope positioning switch, and is connected to the energizing power supply 356 via a conductor 490. The cross slope positioning switch 420 is constructed to establish electrical communication between the energizing power supply 356 and the conductors 490 and 422, in one actuated position thereof, and to establish electrical communication between the energizing power supply 356 and the conductors 490 and 444, in one other actuated position thereof.

The cross slope positioning switch 420, more particularly, includes a differential amplifier 492, a level sensor 494, a command signal source 496, and a signal selector 498. The level sensor 494 is positioned and supported on the main frame 12 and is constructed to sense the cross slope position of the main frame 12 relative to a predetermined horizontal plane, and to provide an output signal 500 responsive to the sensed cross slope position of the main frame 12. The command signal source 496 is constructed to be preset to a predetermined cross slope position of the main frame 12, and has an output signal 502 responsive to the preset cross slope position of the command signal source 496.

The differential amplifier 492 is constructed to receive and compare the output signals 500 and 502 from the level sensor 494 and the command signal source 496, respectively, and the differential amplifier 492 has an output signal 504 which is responsive to the comparison of the output signals 500 and 502 of the level sensor 494 and the command signal source 496, respectively. The signal selector 498 is constructed to receive the output signal 504 from the differential amplifier 492, and to be switchingly positioned in a disconnect position and in a position establishing electrical communication between the conductors 490 and 442 and in a position establishing electrical communication between the conductors 490 and 444, in response to the received output signal 504.

In one form, for example, the command signal source 496 consists of a potentiometer connected to a power supply, such that by adjusting the potentiometer, the voltage level of the output signal 502 can be adjusted to a determinable level corresponding to a particular cross slope level setting of the main frame 12. The level sensor 494 can be of the pendulum-type having a portion connected to a potentiometer and a power supply in such a manner that as the pendulum is moved to indicate a change in the cross slope position of the main frame 12, the voltage level of the output signal 500 is correspondingly changed. The differential amplifier 492 is of a type well known in the art, and the output signal 504 thereof corresponds or is responsive to the comparison of the two output signals 500 and 502 received thereby.

The signal selector 498, in one form, can include a pair of transistor-operated type switches, one such switch being connected to the differential amplifier 492 to provide electrical communication between the power supply 356 and the switch 441 via the conductors 490 and 442, and one such switch being connected to the differential amplifier 492 to establish electrical communication between the power supply 356 and the switch 424 via the conductors 490 and 444.

Thus, the switch 422 is interposed between the control valves 428 and 436 and the switches 420, 422 and 423. In the disconnect position of the switch 424, the left hydraulic cylinder 72*a* and the right hydraulic cylinder 74*a* are not controlled via any of the switches 420, 422 or 423. The switch 441 is interposed between the switches 420 and 423, to selectively establish electrical communication between the switches 420 and 423 and the switch 424.

Assuming the switch 441 is positioned to establish electrical communication between the switches 420 and 424, the switches 420 and 422 will control the energized positions of the control valves 428 and 436, thereby controlling the position of the left elevation positioning assembly 72 and the right elevation positioning assembly 74. In this position of the switch 441, the switch 422 will control the energized position of the control valve 428 and the switch 420 will control the energized position of the control valve 436, in one position of the switch 424, and the switch 422 will control the energized position of the control valve 436 and the switch 420 will control the energized position of the control valve 428, in one other position of the switch 424.

Thus, by selectively positioning the switch 424, the cross-slope control switch 420 is automatically connected to control the left elevation positioning assembly 72 or the right elevation positioning assembly 74, with the other positioning assembly 74 or 72 being controlled by the switch 422. Also, if it becomes desirable to control the left elevation positioning assembly 72 or the right elevation positioning assembly 74 via the switch actuator 474, the position of the switch 441 is changed to establish electrical communication between the switch 423 and the switch 424. In this latter-mentioned position of the switch 441, the switch 422 and the switch 423 can selectively control the control valves 428 and 436, thereby controlling the position of the left and the right elevation positioning assemblies 72 and 74.

In one form, the switches 354, 380, 404, 422 and 423 are of the type generally known in the art as "toggle" switches, each toggle switch actuating or energizing one of the control valves connected thereto. It should also be noted that, in a preferred form, the control valves 382, 358, 400, 428 and 436 are, more particularly, of the type known in the art as "proportional valves", each control valve proportionally controlling the flow of hydraulic fluid therethrough in response to the switch connected between that valve and the energizing power supply 356.

The control apparatus of the trimmer 10 is thus constructed such that the left elevation positioning assembly 72 and the right elevation positioning assembly 74 are selectively and automatically controlled via a toggle-type switch 422, a cross slope control switch 420, and a switch 423, and such that either the left or the right elevation positioning assemblies 72 or 74 can be locked in a predetermined elevated position, the opposite side of the main frame 12 being controlled automatically via the cross slope positioning switch 420. The controls of the trimmer 10 thus are constructed and connected to automatically control the steering of the trimmer 10, to maintain the trimmer 10 in predetermined grade and cross slope positions, and to automatically control the position of the elevated conveyor 44 in a flexible, quick and efficient manner.

The construction of the trimmer 10 thus provides a trimmer having a relatively high degree of control flexibility without a loss of control accuracy, and a trimmer which is particularly constructed to be maneuverable within a relatively confined working area in a positive, efficient, economical and automatically controlled manner.

Changes may be made in the construction and the arrangement of the various parts or the elements of the embodiments as disclosed herein without departing from the spirit and scope of the invention as defined in the following claims.

What is claimed is:

1. A road construction apparatus, comprising:

a main frame having a forward end, a rearward end, a left side, and a right side;

drive means connected to the main frame, drivingly moving the main frame;

a moldboard connected to the main frame, excavatingly engaging a portion of the earth;

a base conveyor connected to the main frame, having one end portion disposed near the moldboard and one end portion disposed near the rearward end of the main frame, receiving a portion of the earth excavated via the moldboard and moving the excavated earth deposited thereon generally toward the rearward end of the main frame, wherein the base conveyor extends generally between the left side and the right side of the main frame, and angularly generally from the forward end toward the rearward end of the main frame, the base conveyor including:

a latching flange connected to the end portion of the base conveyor disposed near the moldboard, having a portion latchingly disposed over a portion of the main frame;

a locking pin secured through a portion of the main frame, generally above the latching flange, securing the latching flange in an assembled position;

a removal pin removably connecting the end portion of the base conveyor disposed near the rearward end of the main frame, to the main frame; and a jack flange connected to the underside of the base conveyor for engaging the earth and forming a pivoting base for pivotally disengaging the latching flange from the main frame upon removal of the locking pin and the removal pin and the lowering of the end portion of the base conveyor disposed near the rearward end of the main frame;

an elevated conveyor pivotally connected to the main frame, having a portion receiving the excavated earth from the base conveyor and depositing the excavated earth at predetermined positions; and means connected to the elevated conveyor, supporting and pivotally moving the elevated conveyor in a predetermined swing path.

2. A road construction apparatus, comprising:

a main frame having a forward end, a rearward end, a left side, and a right side;

drive means connected to the main frame, drivingly moving the main frame;

a moldboard connected to the main frame, excavatingly engaging a portion of the earth;

a base conveyor connected to the main frame, having one end portion disposed near the moldboard and one end portion disposed near the rearward end of the main frame, receiving a portion of the earth excavated via the moldboard and moving the excavated earth deposited thereon generally toward the rearward end of the main frame;

an elevated conveyor pivotally connected to the main frame, having a portion receiving the excavated earth from the base conveyor and depositing the excavated earth at predetermined positions;

a pivot flange connected to the rearward end of the main frame;

a base flange having one end pivotally connected to the pivot flange;

a pivot support connected to the elevated conveyor and pivotally connected to the pivot flange;

a first conveyor actuator having a portion pivotally connected to the main frame and a portion pivotally connected to the base flange, pivotally moving the elevated conveyor in a predetermined swing path in an actuated position thereof; and a second conveyor actuator having a portion pivotally connected to the base flange and a portion pivotally connected to the pivot support, pivotally moving the elevated conveyor in the predetermined swing path in an actuated position thereof.

3. The apparatus of claim 2 wherein the first conveyor actuator and the second conveyor actuator are each defined further as being hydraulic cylinders, each hydraulic cylinder being connected in hydraulic parallel to balance the load imposed on the hydraulic cylinders in actuated positions thereof.

4. The apparatus of claim 2 defined further to include:

a swing support having a portion pivotally connected to the main frame and another portion pivotally connected to the elevated conveyor providing augmenting pivotal support for the elevated conveyor during the operation thereof.

5. A road construction apparatus or the like, comprising:

a main frame having a forward end, a rearward end, a left side and a right side;

a left track connected to the left side of the main frame drivingly moving the main frame;

a right track connected to the right side of the main frame drivingly moving the main frame;

a front track connected to the main frame generally between the left side and the right side thereof and generally near the forward end thereof;

front elevation positioning means connected to the main frame and to the front track raising and lowering the main frame relative to the front track in an actuating position thereof;

left elevation positioning means connected to the main frame and to the left track raising and lowering the main frame relative to the left track in an actuated position thereof;

right elevation positioning means connected to the main frame raising and lowering the main frame relative to the right track means in an actuated position thereof;

a steering arm having one end pivotally connected to the front track, the steering arm being movable in a horizontal plane steeringly moving the front track and movable in a vertical plane via the pivotal interconnection between the steering arm and the front track during the raising and the lowering of the main frame via the front elevation positioning means;

track steering sensor means connected to the main frame having a portion sensing the position of the main frame relative to a control reference and providing an output signal responsive to the sensed position;

means receiving the output signal of the track steering sensor and steeringly moving the steering arm in response thereto;

means actuating the front elevation positioning means, the left elevation positioning means and the right elevation positioning means controlling the grade and slope position of the main frame during the operation of the road construction apparatus;

means supporting the track steering sensor means and positioning the track steering sensor means relative to the main frame from a remote location;

feedback means connected to the front track means and the track steering sensor means providing a feedback signal to the track steering sensor means responsive to the sensed turning position of the front track means;

a base conveyor connected to the main frame receiving a portion of excavated earth and moving the excavated earth deposited thereon generally toward the rearward end of the main frame;

an elevated conveyor pivotally connected to the main frame receiving the excavated earth from the base conveyor and depositing the excavated earth in predetermined positions; and means for supporting and pivotally moving the elevated conveyor means in a swing path generally 180 degrees about the rearward end of the main frame.

6. A road construction apparatus, comprising:

a main frame having a forward end, a rearward end, a left side and a right side;

drive means connected to the main frame, drivingly moving the main frame;

a moldboard connected to the main frame, excavatingly engaging a portion of the earth;

means supported via the main frame, having a portion disposed near the moldboard, receiving a portion of the earth excavated via the moldboard;

an elevated conveyor pivotally connected to the main frame, having a portion receiving the excavated earth from the means receiving the earth excavated via the moldboard and depositing the excavated earth at predetermined positions;

means connected to the elevated conveyor supporting and pivotally moving the elevated conveyor in a predetermined swing path;

front track means connected to the main frame, generally near the forward end thereof, steering the road construction apparatus during the operation thereof;

a steering assembly connected to the front track means and to the main frame steeringly moving the front track means in one position, comprising:

a steering arm having one end thereof connected to the front track means, steeringly moving the front track means;

a steering cylinder pivotally connected to the main frame, having a portion pivotally connected to the steering arm, moving the steering arm in a generally horizontal plane in an actuated position thereof;

means confining the movement of a portion of the steering arm, generally near the connection thereof with the steering cylinder, to a generally horizontal plane;

a track steering sensor connected to the main frame, having a portion sensing the position of the main frame relative to a control reference and providing an output signal responsive to the sensed position; and means receiving the output signal of the track steering sensor and actuating the steering cylinder in response thereto, steeringly maintaining the alignment of the main frame relative to the control reference;

an elevation sensor having a portion sensing the position of the main frame relative to a control reference and providing an output signal responsive to the sensed position;

front elevation positioning means connected to the front track means, having a portion receiving the output signal of the elevation sensor, the front elevation positioning means raising and lowering the main frame relative to the front track means in response to the output signal of the elevation sensor; and sensor support means supporting the elevation sensor and the track steering sensor, comprising:

a support housing connected to the main frame;

a support bar movably positionable in the support housing to controlled positions with respect to the main frame;

means securing and releasing the support bar in predetermined positions in the support housing;

means connected to the end of the support bar, opposite the end thereof movably positionable in the support housing, supporting the track steering sensor;

means having a portion secured to the support bar and a portion movably disposed therein connected to and supporting the elevation sensor;

a threaded extension member pivotally connected on one end thereof to the means movably supporting the elevation sensor;

an extension shaft having one end portion connected to the main frame, the opposite end of the extension shaft threadingly receiving the end portion of the threaded extension member, opposite the end thereof connected to the means movably supporting the elevation sensor; and a handwheel connected to the extension shaft for rotating the extension shaft thereby moving the portion of the means movably supporting the elevation sensor connected thereto, raising and lowering the elevation sensor with respect to the main frame via the threaded extension member and the extension shaft thereby positioning the elevation sensor from a remote position.

* * * * *

UNITED STATES PATENT OFFICE

CERTIFICATE OF CORRECTION

Patent No. 3,946,506 Dated March 30, 1976

Inventor(s) Ralph K. Snow Jr., Warren W. Grist, Joe Bill Kruger

It is certified that error appears in the above-identified patent and that said Letters Patent are hereby corrected as shown below:

Column 3, line 65, "in manner" should be -- in a manner --

Column 17, line 58, "wing actuator 320" should be -- conveyor position control 46 --

Column 18, line 21, "48" should be -- 46 --

Column 18, line 61, "422" should be -- 442 --

Column 19, line 3, "whicl" should be -- which --

Column 19, line 35, "422" should be -- 442 --

Column 20, line 25, "424" should be -- 441 --

Column 20, line 26, "422" should be -- 424 --

Signed and Sealed this

Twentieth Day of July 1976

[SEAL]

*Attest:*

RUTH C. MASON
*Attesting Officer*

C. MARSHALL DANN
*Commissioner of Patents and Trademarks*